US011906271B2

(12) United States Patent
Iliev et al.

(10) Patent No.: US 11,906,271 B2
(45) Date of Patent: Feb. 20, 2024

(54) METHOD TO COMBAT A TARGET

(71) Applicant: BAE SYSTEMS BOFORS AB, Karlskoga (SE)

(72) Inventors: Boyko Iliev, Örebro (SE); Peter Wetterskog, Karlskoga (SE); Thomas Pettersson, Karlskoga (SE)

(73) Assignee: BAE SYSTEMS BOFORS A B, Karlskoga (SE)

( * ) Notice: Subject to any disclaimer, the term of this patent is extended or adjusted under 35 U.S.C. 154(b) by 0 days.

(21) Appl. No.: 17/775,632

(22) PCT Filed: Oct. 22, 2020

(86) PCT No.: PCT/SE2020/051026

§ 371 (c)(1),
(2) Date: May 10, 2022

(87) PCT Pub. No.: WO2021/096406

PCT Pub. Date: May 20, 2021

(65) Prior Publication Data

US 2022/0412693 A1 Dec. 29, 2022

(30) Foreign Application Priority Data

Nov. 13, 2019 (SE) ..... 1900194-0

(51) Int. Cl.
*F41G 7/22* (2006.01)
*F41H 11/02* (2006.01)

(52) U.S. Cl.
CPC ..... *F41G 7/2233* (2013.01); *F41G 7/2206* (2013.01); *F41G 7/2253* (2013.01); *F41H 11/02* (2013.01)

(58) Field of Classification Search
CPC ..... F41G 7/00–7/36; F41H 11/02
See application file for complete search history.

(56) References Cited

U.S. PATENT DOCUMENTS 4,630,050 A * 12/1986 Johnson ..... F41G 7/2246 342/68
4,641,801 A * 2/1987 Lynch, Jr. ..... F42B 10/661 244/3.22
4,997,144 A * 3/1991 Wolff ..... F41G 7/308 244/3.14

(Continued)

FOREIGN PATENT DOCUMENTS

EP 0048068 A1 3/1982
GB 2279444 A 1/1995

(Continued)

OTHER PUBLICATIONS

International Search Report (Nov. 12, 2020) for corresponding International App. PCT/SE2020/051026.

*Primary Examiner* — Matthew M Barker
(74) *Attorney, Agent, or Firm* — WRB-IP PLLC

(57) ABSTRACT

A method is provided to improve the impact point for at least one subsequent projectile fired towards a target, launched after an initial projectile, where the subsequent projectiles can alter their course, based on information on the previous projectiles' time of automatic detonation, to improve the ability to detect a target. A projectile and a fuse are also provided.

9 Claims, 4 Drawing Sheets

(56) References Cited

U.S. PATENT DOCUMENTS

| | | | | |
|---|---|---|---|---|
| 5,379,966 | A * | 1/1995 | Simeone | F41G 7/303 244/3.13 |
| 7,947,936 | B1 * | 5/2011 | Bobinchak | F41G 3/04 701/1 |
| 9,476,677 | B1 * | 10/2016 | Wright | F41G 7/2206 |
| 9,541,350 | B1 * | 1/2017 | Sierchio | F41G 7/346 |
| 2010/0117888 | A1 | 5/2010 | Simon | |
| 2017/0300047 | A1 | 10/2017 | Kolanek et al. | |
| 2017/0328683 | A1 * | 11/2017 | Smith | G01S 5/0072 |

FOREIGN PATENT DOCUMENTS

| | | | | |
|---|---|---|---|---|
| GB | 2284465 | A * | 6/1995 | F41G 7/2213 |
| WO | WO-2019132758 | A1 * | 7/2019 | F41G 3/02 |

* cited by examiner

200

METHOD TO COMBAT A TARGET

BACKGROUND AND SUMMARY

This patent application concerns a method of using artillery with guided ammunition to combat targets. Furthermore, the patent application also concerns a projectile and a fuse.

When combating targets such as missiles, aircrafts or helicopters, artillery pieces will traditionally use projectiles with a timed fuse or a proximity fuse. Projectiles with a timed fuse are set to explode/detonate at a certain time, determined by parameters such as launch speed, distance to target, etc. Alternatively, the projectile uses a proximity fuse that will cause the projectile to explode/detonate in proximity of the target, once it has been detected by a sensor inside the projectile. This could be a type of sensor called a target seeker.

Examples of methods and devices used to combat targets with guided projectiles fitted with target seekers can be found in patent specification EP 0 048 068 B1, which describes a combat method using guided, explosive projectiles or missiles equipped with target trackers/seekers to automatically guide the projectile or missile towards the target. To improve accuracy, the projectile or missile fired in a burst is fitted with transmitters that activate when the projectile/missile detects a target. Once activated, the transmitters send a signal that indicates the position of the target in relation to the projectile and subsequent projectiles. The subsequent projectiles, guided by the signal indicating the location transmitted from the initial projectile, alter their trajectory to be in line with the target trajectory. Therefore, the subsequent projectiles get a more accurate trajectory towards the target. The invention presented in EP 0 048 068 B1 differs from the invention described in this patent application, in that combat involving subsequent projectiles is based solely on data from the target seeker.

It is desirable to improve the ability to combat targets when several projectiles are fired towards a target in succession.

The invention concerns, according to an aspect thereof, a method to improve the impact point of at least one subsequent projectile fired at a target, launched after an initial projectile, where subsequent projectiles can alter their trajectory to improve target detection by using information on the previous projectiles' time of automatic detonation.

For a method to improve the impact point of at least one subsequent projectile fired at a target, the following aspects apply;

the previous projectiles fired at the target must detect the target and transmit the target location data to the subsequent projectiles.

the subsequent projectiles must use the received target location data to set their course towards the target, and detonate on an external command or at an estimated impact point based on the predicted target trajectory.

the predicted target trajectory must be calculated based on the target location data.

the time of detonation must occur at the optimal impact point based on the predicted target trajectory.

the external command must be a signal transmitted from a fire control system.

the target location data must be a direction relative to the projectile.

the target location information must be a location specified in a three-dimensional positioning system.

the location data can be used to direct the sensitivity of a sensor fitted inside the projectile.

the sensitivity of the sensor can change from omnidirectional, 360 degrees, to sensitivity in a segment <90 degrees.

Furthermore, the invention consists of or comprises, according to an aspect thereof, a projectile that uses the aforementioned method to improve the impact point.

The invention also consists of or comprises, according to an aspect thereof, a fuse to be used on a projectile that uses the aforementioned method to improve the impact point.

The advantage of aspects of the present invention is that the action by launched projectiles can be utilised more effectively against a target. The first projectile, which automatically detonates, transmits, directly using communication or indirectly by providing timed data to the subsequent projectiles, that the target has not been detected. Furthermore, the target can be detected when firing and the position of the target can be transmitted to subsequent projectiles, which improves the ability for subsequent projectiles to combat the target. The subsequent projectiles set their course towards the target and detonate when the target is detected by a sensor inside the projectile, or alternatively, at an estimated time or when an external signal is transmitted to the projectile.

BRIEF DESCRIPTION OF THE DRAWINGS

The invention will be described in more detail below, with reference to the accompanying figures therein.

DETAILED DESCRIPTION

Figure 1:
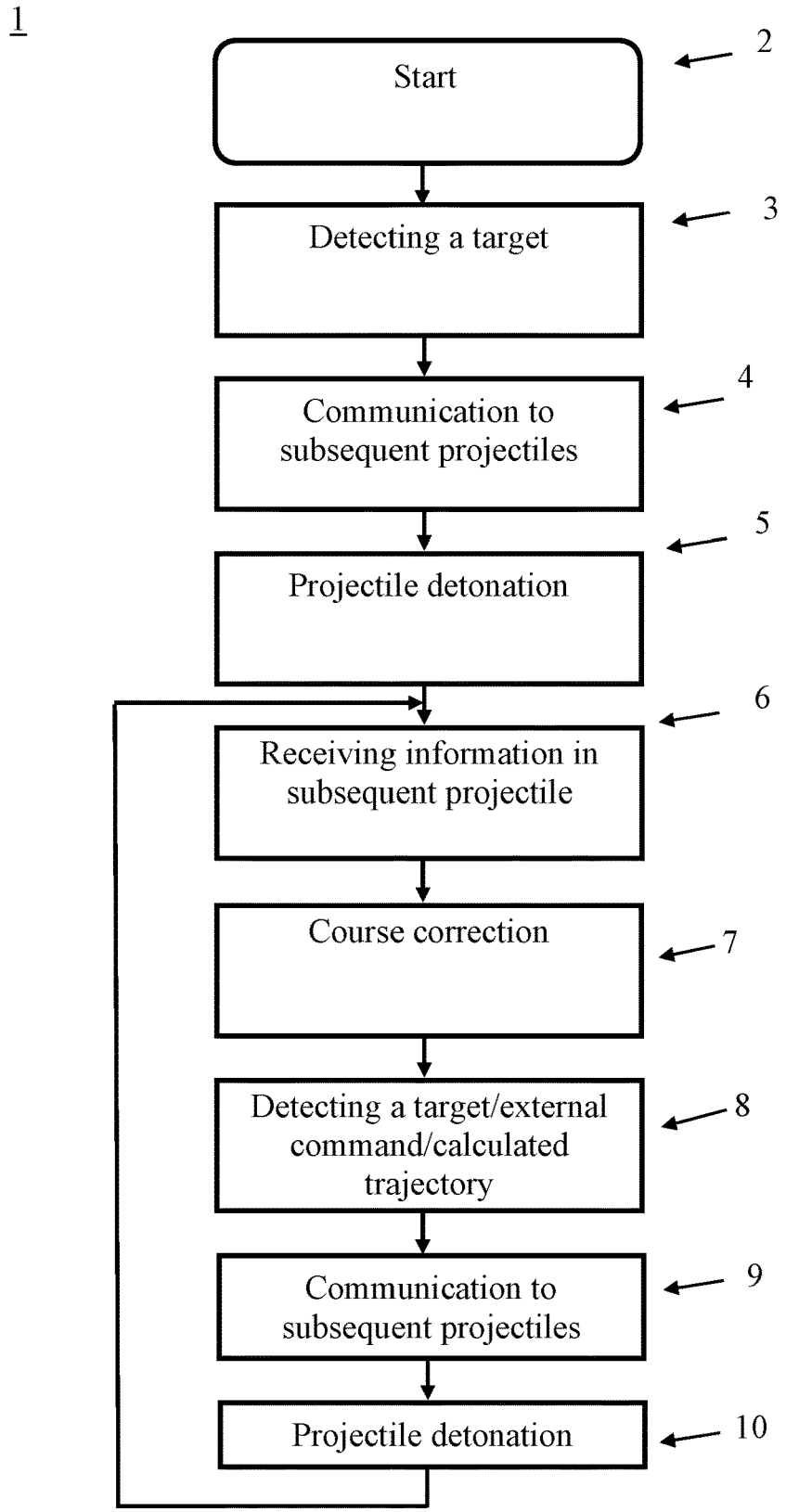
FIG. 1 shows a flow chart for a method using guided projectiles to combat a target according to an embodiment of the invention.

When combating a moving target, i.e. air targets, with unguided projectiles fired from barrel weapons, projectiles are aimed at the point where the target will be when the projectiles reach the target. These type of points, commonly called points of aim, are predicted based on measurement data and estimations. By the same estimation, you can also predict the trajectory of the projectiles fired at the target. The estimate or prediction is based on the projectile's previous positions and a hypothesis on how the projectile will behave in the future.

A system designed to use artillery and projectiles to combat targets can consist of or comprise three parts; fire control, weapons and projectiles. Such a system can also be called an artillery-based anti-aircraft defence. Projectiles are to be understood as various forms of projectiles, such as grenades, missiles and/or rockets, which intended use is to combat a target. A fire control system used in an artillery-based anti-aircraft defence includes one or more sensors and several methods for managing and evaluating the sensor data. The sensor or sensors that are included in, and used by, the fire control system are also referred to as sight. Refined information from the sight is used to control the direction of both sight and weapons.

In a first embodiment, the projectiles are fired in succession without moving the launcher, neither laterally nor vertically, making the projectiles travel in a line, or close to a line, towards the target. The launched projectiles are programmed with a time slot, i.e. the sensors inside the projectiles can detect a target during a certain time interval. In this case, the initial projectiles' time slot is communicated to the subsequent projectiles. If the target isn't detected by the initial projectile within the set time slot, the projectile will detonate. This, in turn, informs the subsequent projectiles that the target was not found within the target seeker's/sensor's search area. The subsequent projectiles can still obtain this information when there is a lack of communication from the projectiles in front, by noting that nothing is received when the target remains undetected by the projectiles in front. Alternatively, the subsequent projectiles can be fitted with a sensor, i.e. an optical sensor, that can detect the detonation of the projectiles in front, in order to obtain this information. If the projectiles in front have been unable to detect the target, the subsequent projectiles can alter their trajectory in order to be in a more favourable position to detect the target. Alternatively, the projectiles receive information that no target has been detected before automatic detonation. In the event that several subsequent projectiles are launched, different trajectories can be selected in order for the subsequent projectiles to cover a larger area.

In a second embodiment, the projectiles are fired in succession without moving the launcher, neither laterally nor vertically, making the projectiles travel in a line, or close to a line, towards the target. When the initial projectile detects a target, the communication to the first subsequent projectile can be simplified by transmitting only a direction. The first subsequent projectile receives the information from the initial projectile and sets its course towards the communicated direction. When the first subsequent projectile detects the target, the projectile transmits a direction to the following projectile and so on.

In a third embodiment, the projectiles are launched towards the target in an optional way. In this embodiment, the relative position of the launched projectiles is unknown. Each projectile is provided with a device that measures its current position, i.e. by inertial or satellite navigation, or a combination of inertial and satellite navigation. When the initial projectile detects a target, it transmits the position of the initial projectile and the position of the target in relation to the current position of the subsequent projectiles. The initial projectile transmits the target information to the first subsequent projectile, including the position of the initial projectile and the location of the target in relation to the initial projectile's position. The second projectile calculates, based on its current position, the position of the initial projectile and the location of the target in relation to the first projectile, and the maneuvers required to steer the second projectile towards the target.

FIG. 1 shows a flow chart for a method using guided projectiles to combat a target, step 1. As combat is initiated, step 2 in FIG. 1, the sight is directed towards the target. Usually, this is made possible by an external device, such as a reconnaissance radar, that continuously delivers information on the target position as a function of time. This external device is called the assigning device. Parallel to the sight being aimed towards the target, the barrel can be aimed at a preliminary calculated point of aim, the position of which is based on data from the assigning device. Once the barrel is in position, the combat can be initiated by launching the projectiles towards the target. The projectiles travelling towards the target have been fitted with a target seeker, sensor or a proximity fuse that can detect a target. When the first launched projectile detects a target, or when the first of the launched projectiles detects a target, it registers the target position in relation to the projectile, which can be seen in step 3, Detecting a target, in FIG. 1. The target information is transmitted in step 4, Communication to subsequent projectiles, in FIG. 1, by the initial projectile transmitting a signal to the subsequent projectiles. This communication can be sent using purpose-built communication equipment, such as various forms of radio communication or optical communication, or by other means. In every embodiment, each projectile has its own unique address, and the target information is transmitted to all the subsequent projectiles. The next step, after the initial projectile has transmitted the information to the subsequent projectiles, is step 5, Projectile Detonation. In an alternative embodiment, detonation can only take place once the initial projectile receives a confirmation from the subsequent projectiles. In the embodiment when the projectile is launched with a time slot, the first embodiment, the projectiles will automatically detonate at the end of the time limit. In this case, the communication can be sent to the subsequent projectiles before the detonation, and/or the subsequent projectiles can be programmed, or otherwise set, to know the initial projectile's time slot and thereby also the end of the time limit.

In the step 6, Receiving information in subsequent projectile, the subsequent projectiles are updated with information relating to where the target is located. The subsequent projectiles can, depending on their current position and estimated course, be steered to improve their trajectory in order to be in a more favourable position in relation to the target. The process of steering the projectile to a more favourable position in relation to the target can be found in step 7, Course correction. If the projectiles are launched using a time slot, as per the first embodiment, and no information is received by the subsequent projectiles from the projectiles in front, and the projectiles in front have detonated at the end of the time slot, the subsequent projectiles will still know that no target has been detected. As the subsequent projectiles are aware of the time slot of the initial projectile and therefore the time of self-destruction/automatic detonation, the subsequent projectiles can determine that the initial projectile has been unable to detect the target, as the time limit has been reached and no target information has been received. The subsequent projectiles can then correct their course in order to increase the possibility of detecting the target.

The subsequent projectile or projectiles will steer to a position where it/they can detect the target using the target seeker, sensor or proximity fuse. If the target cannot be detected, the projectile can be set to detonate by using an external command, i.e. a signal communicated from the assigning device. The radar fitted on the assigning device can detect both the projectile and the target. Therefore, it can send communication to the projectile to make it detonate at a suitable time to impact the target. Even if the seeker is unable to detect a target and the projectile receives an external signal to detonate, the subsequent projectile has still received the target location. Therefore, it may have changed its course to a position that is closer to the target, and therefore it may be in a position that is more favourable in terms of causing damage to the target, than if no information had been received at all. Communication with the projectile can be adapted based on the circumstances and can, in its simplest form, only include a signal to detonate. As an additional alternative, in the event the target seeker is unable to detect the target and it is not possible to communicate with the projectile (i.e. due to prohibited radio communication), the projectile can be set to detonate by calculating the target trajectory based on the information on the target location already received from the previous projectile. The previous projectile can communicate the target's relative location data, but also the absolute location data if the projectile is fitted with a positioning system. Furthermore, the projectile can assess the target's speed based on the location information. Subsequent projectiles can make assumptions about the target's trajectory based on an estimation of the target's location and speed. Therefore, an optimal impact point for the detonation can be calculated based on this estimation of the target's trajectory. Even if the seeker is unable to detect a target and the projectile detonates based on an optimal impact point, the subsequent projectile has still received the target location. Therefore, it may have changed its course to a position that is closer to the target, and as such it may be in a position that is more favourable in terms of causing damage to the target, than if no information had been received at all.

Which one of the three different modes that will generate the signal for the projectile to detonate is determined in step 8, Detecting a target/external command/calculated trajectory. When a decision has been made to detonate the projectile, the subsequent projectile can send an updated position, measured or calculated, of the target's location as described in step 9, Communication to subsequent projectiles, carried out in the same way as in step 4. Whereby step 10, Projectile detonation, is carried out in the same way as in step 5. In the first embodiment, where the projectiles are launched using a time slot, the subsequent projectiles will also detonate automatically at the end of the time limit if no target has been detected. Any additional subsequent projectiles will repeat this procedure from step 6.

Figure 2:
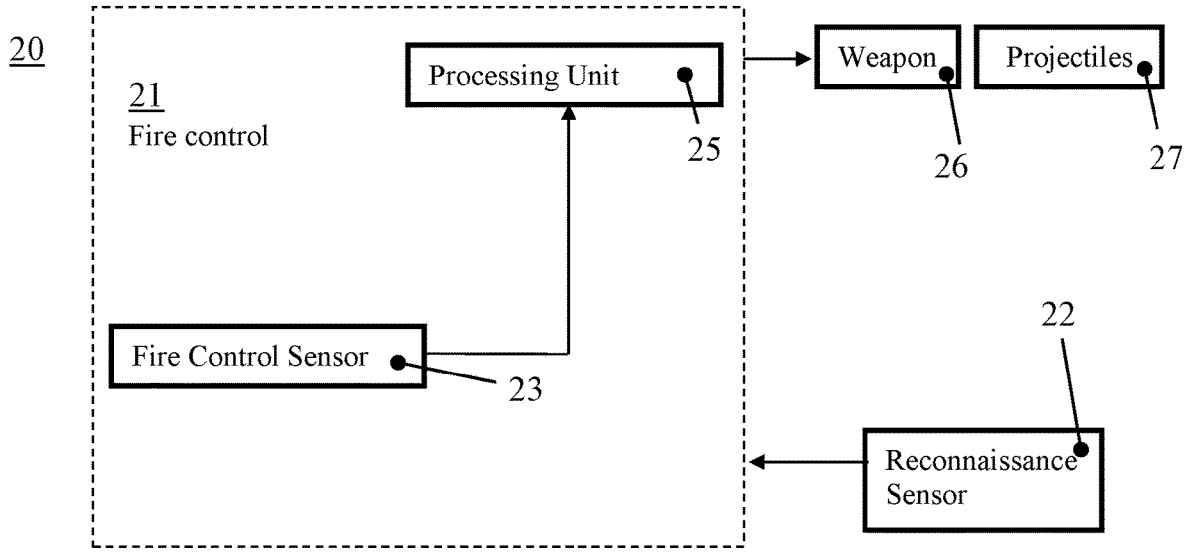
FIG. 2 shows a block diagram of a device used to combat a target according to an embodiment of the invention.

An artillery-based anti-aircraft defence system (20), as described in FIG. 2, consists of or comprises fire control (21), one or more weapons (26) and projectiles (27) that can be fired at a target. The system (20) receives an assignment from an external reconnaissance sensor (22), which can scan large volumes of great depths at the expense of accuracy and measuring frequency. The artillery-based anti-aircraft defence (20) includes a fire control sensor (23) that, once assigned, can measure the location of the individual target and the position of the launched projectiles in a small sector with limited depth, but with high accuracy and high measuring frequency. The processing unit (25) is used to estimate the points of aim that the weapons (26) should be aimed towards. Equipment for communicating with the projectile may be included. However, this is not shown in the figure.

Figure 3:
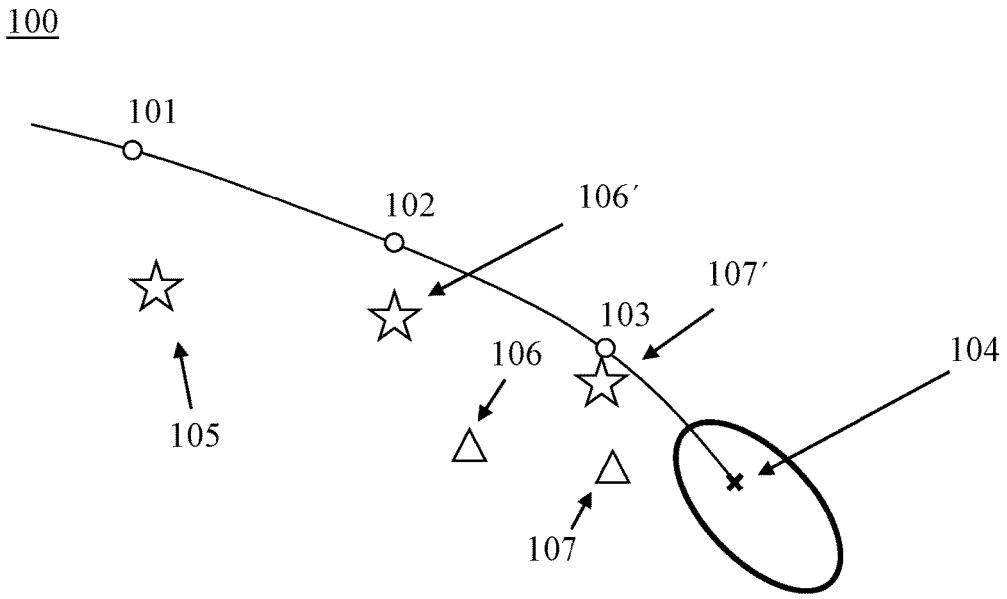
FIG. 3 shows the movement of a target according to an embodiment of the invention.

FIG. 3 shows a target area (100) for a target moving towards a protected object (104) in the second and third embodiment. The target will pass a number of positions or points on route towards the protected object (104). At point 101, which is far from the protected object, the target can be combated with the first launched projectile fired early (105). Although the first projectile (105) is quite a long distance away from the target, it can still detect the target at point 101 by using its target seeker, sensor or proximity fuse. The first projectile (105) communicates information on the target's position to the subsequent projectiles, shown in FIG. 3 as projectile 106 and 107. Projectile 105 subsequently detonates, whereby shrapnel or other blast material hits the target on its route towards the protected object. This possibly eliminates the target or, alternatively, the target continues towards the protected object. If the target continues towards the protected object, the target will eventually reach point 102. Projectile 106 has started a course correction in order to move to a more favourable position, where it will detonate at (106') once the target is detected at point 102. Before the second projectile (106) detonates, it communicates the target information to the subsequent projectile (107), which in turn performs a course correction to get into an even more favourable position for detonation (107') when the target is detected at point 103.

Figure 4:
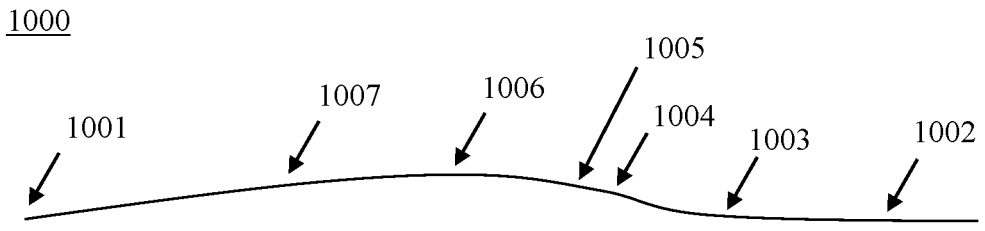
FIG. 4 shows a target trajectory according to an embodiment of the invention.

FIG. 4 shows a target trajectory (1000) towards a protected object (1001) in the second and third embodiments. The target is flying towards the protected object (1001). The target is detected by a reconnaissance sensor as it passes point 1002. The reconnaissance sensor assigns a fire control sensor. The fire control sensor locates the target somewhere between point 1002 and point 1003, and begins to track and measure the target's position and speed. At point 1003, the target starts to change its course, e.g. in order to see the protected object (1001). At point 1004, the target has finished changing its course. At point 1005, the target begins to set a course that strives to steer the craft to hit the protected object (1001). The fire control can start to predict the point of aim 1007 once the target passes point 1006. The prediction is based on data from the fire control sensor and optionally a hypothesis about which guidance law is used by the target. Combat with the target can be initiated early and the first projectile launched at the target can communicate the target's position to the subsequent projectiles. The first subsequent projectile sets its course towards the target and when the target is detected, it communicates the target's position to the second subsequent projectile. If the first subsequent projectile is unable to detect the target, it can detonate using an estimated target trajectory based on previously received position information on the target, or by an external command, i.e. communicated from a sensor, such as a radar, that measures the projectile's as well as the target's position. There is redundancy in the subsequent projectile being able to detonate through; detection using a target seeker; a calculated target trajectory; or through an external command. If the seeker is unable to detect the target, the projectile can be detonated using a calculated trajectory or an external command instead. However, if there is interference that renders external commands impossible, the projectile can be detonated using the target seeker or the calculated target trajectory. If the projectile does not receive information to detonate from the target seeker nor the external signal, the calculated target trajectory can be used to detonate the projectile. Once the first subsequent projectile has detonated, the second subsequent projectile sets its course towards the target, and the process continues.

Figure 5:
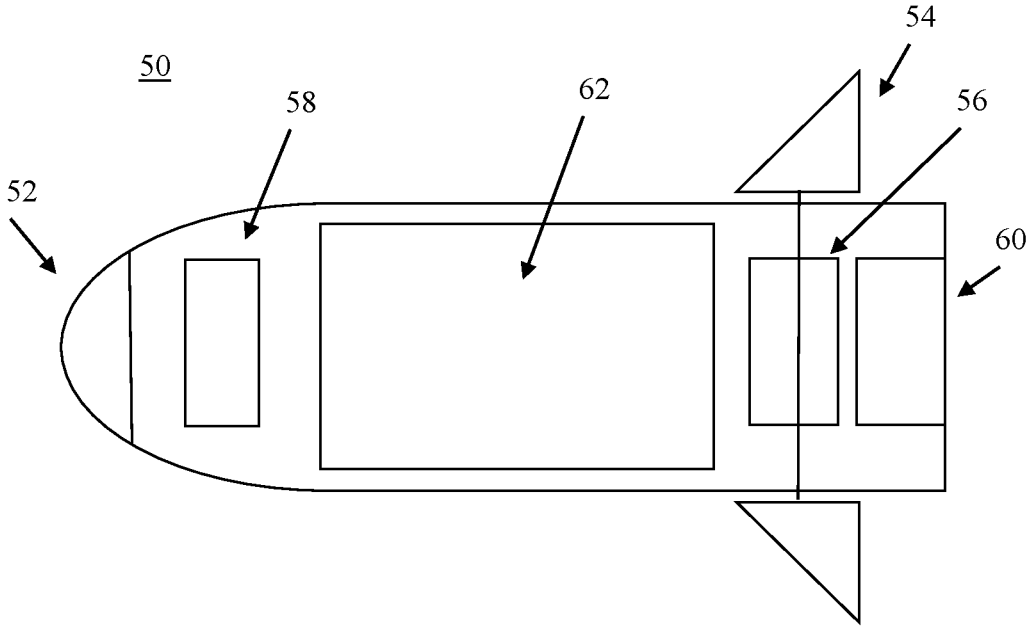
FIG. 5 shows a schematic view of a projectile according to an embodiment of the invention.

FIG. 5 shows a schematic view of a projectile (50) fitted with a sensor (52), such as an optical or electromagnetic seeker, a proximity fuse or a different sensor.

The projectile is also fitted with control devices, such as fins (54), or other means of control, and a servo (56) or a different actuator to control the fins or other means of control. A processing unit (58), such as a microprocessor, receives information from the sensor (52), and estimates possible guidance laws, which the processor communicates to the servo (56), that in turn controls the fins (54) to move the projectile (50). The processor (58) also communicates with a communication unit (60) in order to transmit signals to the subsequent projectiles.

The communication unit (60) can also receive information from an external transmitter, i.e. information to detonate the projectile at a specific time, or information on the target's position, transmitted from the projectiles in front. Furthermore, the projectile (50) includes a warhead (62). The sensor (52) can be provided with a device that controls the sensitivity of the sensor, such as directional sensitivity, i.e. by controlling the lobe of an antenna. This can improve the sensitivity in a specific area, i.e. in an area where it's assessed that the target will pass.

Figure 6:
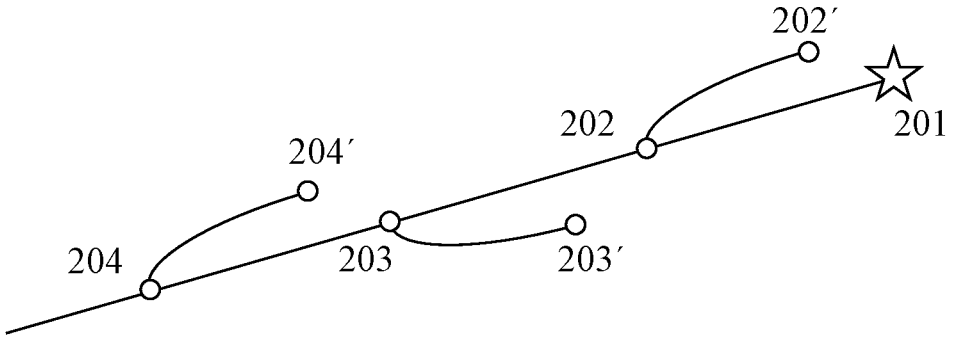
FIG. 6 shows a projectile trajectory according to an embodiment of the invention.

FIG. 6 shows a combat procedure (200) in the first embodiment, where projectile 201, 202, 203 and 204 have been set with a time slot and launched in succession towards a target in a projectile trajectory. The time slot, also known as time gate, means that the projectile's proximity fuse is active during a certain period of time, from a first point of time to a second point of time (the end of the time limit). If the proximity fuse is unable to detect a target during the set time slot, the projectile will self-destruct/automatically detonate/automatically destruct.

The first projectile (201) detonates at the end of the time limit. The subsequent projectiles (202, 203 and 204) are programmed or otherwise informed of the initial projectile's time slot. As the initial projectile (201) automatically detonates at the end of the time limit, the subsequent projectiles change their course to 202', 203' and 204', as the current trajectory is not within sufficient proximity to detect the target. Some time after the initial projectile's (201) detonation, the subsequent projectiles (202, 203 and 204) have moved into their new trajectories. Preferably, the subsequent projectiles will spread out to increase the probability that one of them will detect the target. Different algorithms can be used to improve the possibility of detection, depending on the current situation regarding the assumed target, distance to target, type of projectile, etc.

The invention is not limited to the specific embodiments described, but can be varied in different ways within the scope of the claims.

It is understood that the number of sensors, launching device, or systems of elements and details included in the method of fire control against targets have to be adapted to the weapon systems, platforms and other design characteristics currently available.

It is also understood that the method of fire control against targets, as described above, can be applied to virtually any guided vessel or system, including aircrafts, unmanned aircrafts and missiles.

The invention is not limited to a certain form of target, but can be used for various target types, such as surface targets or air targets.

Furthermore, it can use all forms of projectiles, including grenades, explosive grenades, missiles and rockets.

The invention is also not limited to a certain number of projectiles or targets, but can be adapted to the number of target objects or projectiles currently available.

The invention claimed is:

1. A method to alter an impact point of a projectile launched at a target, comprising launching a first projectile at a target, launching a second projectile at the target, the second projectile having knowledge of a time when the first projectile will automatically detonate, detecting the target with the first projectile and transmitting target position information to the second projectile with the first projectile, automatically detonating the first projectile at an end of a programmed time period, and altering a course of the second projectile based on information regarding the time of automatic detonation of the first projectile.

2. The method to alter the impact point of the projectile according to claim 1, comprising setting a course of the second projectile based on received target position information, and detonating the second projectile on an external command or at an estimated impact point based on an estimated trajectory of the target.

3. The method to alter the impact point of the projectile according to claim 2, comprising estimating the target's trajectory using the target's position information.

4. The method to alter the impact point of the projectile according to claim 3, comprising using the estimated target trajectory to calculate an optimal impact point for detonation.

5. The method to alter the impact point of the projectile according to claim 2, comprising using a signal transmitted from a fire control system as an external command.

6. The method to alter the impact point of the projectile according to claim 1, wherein the target position information comprises a direction of the target relative to the first projectile.

7. The method to alter the impact point of the projectile according to claim 1, wherein the target position information is a specified location in a three-dimensional positioning system.

8. The method to alter the impact point of the projectile according to claim 1, wherein the target position information is used to direct a sensitivity of a sensor inside the second projectile.

9. The method to alter the impact point of the projectile according to claim 8, further comprising changing the sensitivity of the sensor from omnidirectional, 360 degrees, to sensitivity in a segment of less than 90 degrees.

* * * * *